United States Patent [19]

Lund

[11] Patent Number: 4,644,932

[45] Date of Patent: Feb. 24, 1987

[54] METHOD AND DEVICE FOR ENERGY RECOVERY BY MANUFACTURING OF ASPHALT IN BULK

[75] Inventor: Ivar Lund, Ottestad, Norway

[73] Assignee: Ameco A/S, Hamar, Norway

[21] Appl. No.: 598,306

[22] PCT Filed: Jul. 4, 1983

[86] PCT No.: PCT/NO83/00026

§ 371 Date: Mar. 5, 1984

§ 102(e) Date: Mar. 5, 1984

[87] PCT Pub. No.: WO84/00377

PCT Pub. Date: Feb. 2, 1984

[51] Int. Cl.[4] ..... E01C 19/45; F24H 1/00

[52] U.S. Cl. ..... 126/343.5 A; 208/39; 432/98

[58] Field of Search ..... 126/343.5, 343.5 A; 432/3, 97, 98; 208/39

[56] References Cited

U.S. PATENT DOCUMENTS

| | | | |
|---|---|---|---|
| 3,144,864 | 8/1964 | Heijnis | 126/343.5 A |
| 3,554,449 | 1/1971 | Currie | 126/343.5 A X |
| 3,577,976 | 5/1971 | Heller | 126/343.5 A |
| 3,604,693 | 9/1971 | Groepler et al. | 126/343.5 A X |
| 4,161,391 | 7/1979 | Parker | 126/343.5 A |
| 4,477,250 | 10/1984 | Brashears et al. | 126/343.5 A X |

*Primary Examiner*—Edward G. Favors
*Attorney, Agent, or Firm*—Roberts & Floyd

[57] ABSTRACT

Method and device for manufacturing of asphalt bulk masses where a substantial part of the heat energy of the furnace gases from the drying and mixing process is transferred to the bulk mass fractions before those are supplied to the drying and mixing process and where the furnace gases by this process at the same time are cleaned for pollutions. Bulk masses are directed downwards between two parallelly arranged inclined planes (1, 5) where the lower inclined plane (1) comprising horizontally arranged downwards directed ribs (2) directing the furnace gases to the lower side of the bulk masses and where the second inclined plane (5) comprising vertically arranged ribs (4) suctioning the cleaned furnace gases up from the bulk masses after a substantial part of the heat energy being transferred to the bulk masses. At the lower and upper ends of the inclined planes accumulations of the bulk masses (7, 11) are maintained for preventing air from the atmosphere to penetrate into the system. The bulk mass fractions thereafter are transferred to the drying and mixing process, thereby having accumulated a substantial amount of heat energy and the bitumen components being transferred with the furnace gases, as well as other pollutions.

6 Claims, 2 Drawing Figures

METHOD AND DEVICE FOR ENERGY RECOVERY BY MANUFACTURING OF ASPHALT IN BULK

Figure 1:
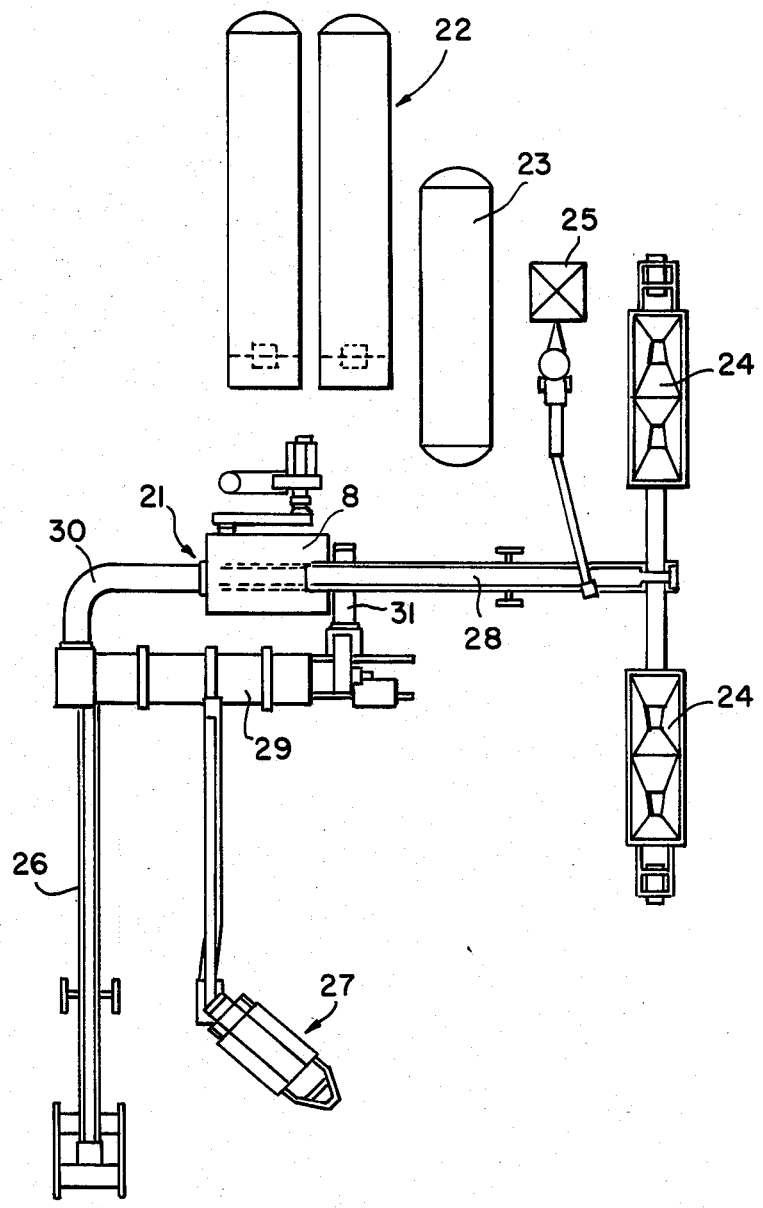

The invention is a method and a device for energy recovery during manufacture of asphalt in bulk.

Today smoke gasses from the manufacturing of asphalt in bulk normally are cleaned by scrubbers or bag filters. Both systems have disadvantages which negatively influence the processes, both operationally and economically.

In known scrubbers the pollutants of the gases are absorbed by a liquid, usually water. This process includes a high energy consumption and also is dependent on water supply. A high amount of condensation from the oil products creates problems with clogging of jets which in turn causes disturbances in the system. In addition, sulphur deposits also create difficulties. For these reasons, use of scrubbers demands a considerable amount of energy and maintenance work.

Bag filters, on the other hand, have a considerable limitation in that the cloth is destroyed at temperatures exceeding about 230° C. Furthermore the compositions of bitumen will condense and pack the clock in the bag filters.

By means of the features mentioned in the characterizing clause of the claims, these unfortunate results of the prior art are overcome. In addition, a considerable energy recovery is achieved in that the heat energy of the smoke gases is used for preheating the bulk before it is supplied to the drying and mixing process.

Figure 2:
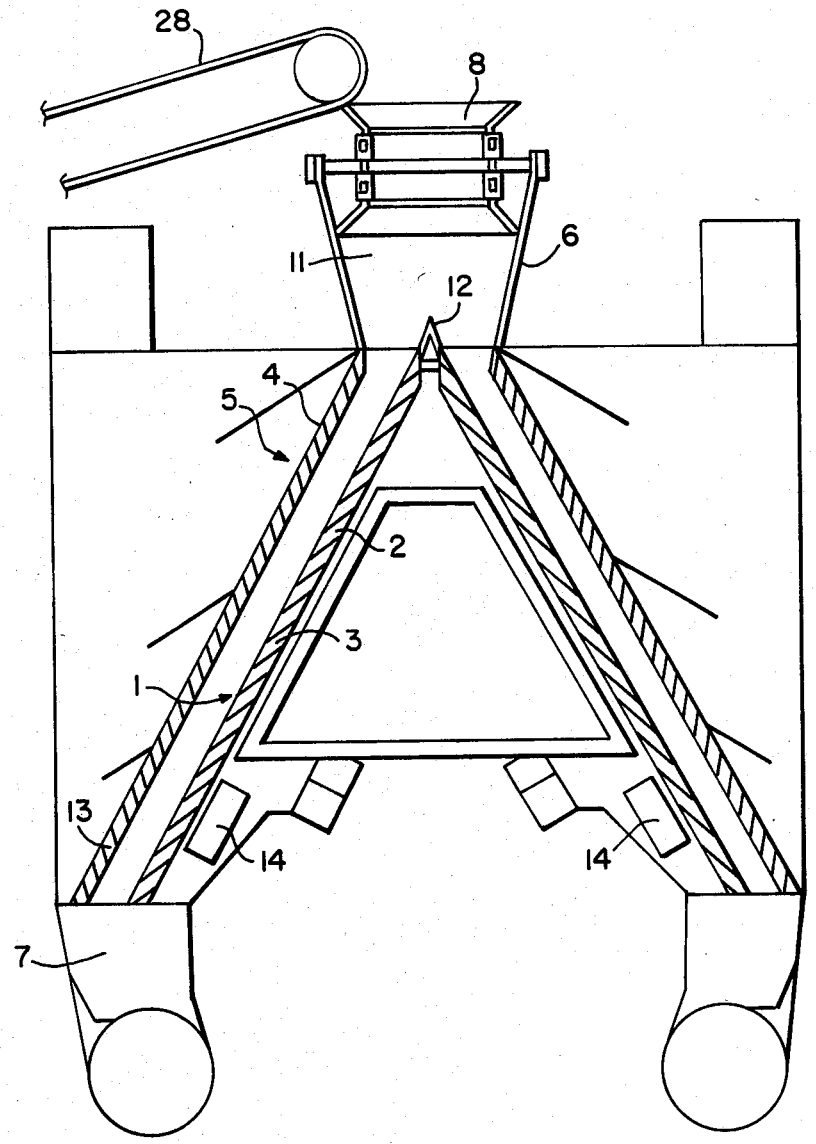

In the drawing,

FIG. 1 discloses schematically a total plant for manufacturing asphalt in bulk and FIG. 2 discloses a vertical section through the device according to the invention.

FIG. 1 discloses a total plant for manufacturing asphalt in bulk according to the invention. Two bulk fractions are supplied through feeding pockets 24, whereas filler is supplied from a silo 25 to a conveyor 28 which transports the bulk to the device according to the invention. The drawing discloses also bitumen tanks 22, an oil tank 23, doser device 27 for recirculation and a conveyor 26 for withdrawal of the end product.

The waste gases from the mixing drum 29 are directed by channels 30 to the device 21. After treatment in the device, the bulk is transported by a transport means 31 to the input of the mixing drum 29.

The device 21 is disclosed in vertical section on FIG. 2. The conveyor 28 transports the bulk to the elongated funnel 6 where the bulk is distributed equally along the length of the funnel by a scraper conveyor 8. In the lowest part of the funnel 6 a packing of bulk, generally denoted 11, is created. This packing or plug prevents air in the environment from penetrating into the device 21. A cam 12 divides the bulk in the funnel into branches for treatment in symmetrically arranged sets of inclined planes.

Each inclined plane comprises a lower inclined wall 1 and an upper inclined wall plan 5 being arranged in parallel and at a distance from each other. In one embodiment, the free distance between the walls is 200 mm and the sloping angle is 14° to the vertical. Each inclined wall 1, 5 comprises a grating 3, 13 to which horizontally fixed ribs 2, 4 are arranged. The ribs 2 in the first wall 1 are arranged sloping downwards against the second wall 5, the ribs thereby partly overlapping each other. The ribs 4 in the wall inclined plane 5 are arranged vertically.

The combustion gasses supplied to the device from the mixing drum 29 by channels 30, are supplied to the lower side of the first inclined wall 1 and pressed through the ribs 2 against the bulk masses sliding down the inclined plane from the funnel 6. The gasses disperse a substantial part of their heat energy to the bulk masses and simultaneously are cleaned of pollutants. The gasses are then sucked up through the ribs 4 in the second inclined wall 5 and further directed to the environment.

To cause the bulk masses to move downwards between the inclined walls, vibrator devices 14 are used to vibrate the inclined planes. Further, to prevent the bulk masses from packing or compressing, the lower edge of the ribs 2 are provided with teeth comprising alternating recesses and webs, the webs in a rib being arranged above the recesses in the rib beneath. The bulk masses are thereby disengaged as they fall from rib to rib.

A conveyor is arranged at the bottom of the inclined planes for transportation of the bulk masses which have been treated. The conveyor is permanently set to maintain a packing or plug 7 with bulk masses, preventing air from penetrating into the system from the environment.

By means of the device according to the invention, a remarkable amount of energy is recovered as a substantial part of the energy in the furnace gases is transferred to the bulk masses, whereas at the same time, additional energy consumption for cleaning the gases is avoided. Additional bitumen substances transferred by the furnace gases are deposited in the bulk masses and recycled back to the process.

What is claimed is:

1. Method for manufacture of asphalt in bulk comprising:

(a) conducting the asphalt in bulk downwardly along an inclined plane, having an upper wall and a lower wall, by means of gravity;

(b) vibrating said inclined plane to move said bulk, and;

(c) conducting furnace gasses upwardly within said plane through said bulk.

2. The method of claim 1 including the step of directing the furnace gasses through the lower wall of the inclined plane in a downward direction against the lower surface of the asphalt bulk.

3. The method of claim 2 including thes tep of directing the furnace gasses through the upper wall of the inclined plane in a vertical direction away from the upper surface of the asphalt block.

4. Device for the manufacture of asphalt in bulk comprising in combination;

(a) an inclined plane, having an upper and lower wall, thourgh which the asphalt bulk passes;

(b) said lower wall comprising a series of horizontal, partly overlapping ribs aligned to move, in a downward direction, gasses entering the plane;

(c) said upper wall comprising a series of horizontal ribs aligned to direct, in an upward direction, gasses exiting the plane;

(d) said upper and lower walls in parallel alignment one to another; and, (e) means to direct furnace gasses onto said lower wall and to remove said gasses from said upper wall;

Whereby heat is transferred from said gasses to said bulk and pollutants are transferred from said gasses to said bulk.

5. The device of claim 4 including means at the top of the inclined plane to accumulate an amount of asphalt bulk entering the plane sufficient to plug the entrance to the inclined plane and prevent the entrance of environmental air.

6. The device of claim 5 including means at the base of the inclined plane to accumulate an amount of asphalt bulk leaving the inclined plane to plug the exit of the inclined plane to prevent entrance of environmental air.

* * * * *